US010016755B2

(12) United States Patent
LaCroix

(10) Patent No.: US 10,016,755 B2
(45) Date of Patent: Jul. 10, 2018

(54) MANUAL PIPETTE WITH SELECTABLE PLUNGER FORCE

(71) Applicant: Integra Biosciences AG, Zizers (CH)

(72) Inventor: Christopher LaCroix, Bedford, NH (US)

(73) Assignee: INTEGRA BIOSCIENCES AG (CH)

( * ) Notice: Subject to any disclaimer, the term of this patent is extended or adjusted under 35 U.S.C. 154(b) by 317 days.

(21) Appl. No.: 14/988,150

(22) Filed: Jan. 5, 2016

(65) Prior Publication Data

US 2016/0199830 A1 Jul. 14, 2016

Related U.S. Application Data

(60) Provisional application No. 62/101,038, filed on Jan. 8, 2015.

(51) Int. Cl.
*B01L 3/02* (2006.01)

(52) U.S. Cl.
CPC ..... *B01L 3/0217* (2013.01); *B01L 3/0224* (2013.01); *B01L 2200/028* (2013.01); *B01L 2200/06* (2013.01); *B01L 2200/087* (2013.01)

(58) Field of Classification Search
CPC ..... B01L 3/0217
See application file for complete search history.

(56) References Cited

U.S. PATENT DOCUMENTS

| | | | | |
|---|---|---|---|---|
| 3,933,048 | A * | 1/1976 | Scordato | B01L 3/0217 422/927 |
| 4,744,955 | A | 5/1988 | Shapiro | |
| 4,909,991 | A | 3/1990 | Oshikubo | |
| 5,104,624 | A | 4/1992 | Labriola | |
| 5,187,990 | A | 2/1993 | Magnussen, Jr. et al. | |
| 5,320,810 | A | 6/1994 | Al-Mahareeq et al. | |
| 5,531,131 | A | 7/1996 | Sabloewski | |
| 5,650,124 | A | 7/1997 | Gilson | |
| 5,792,424 | A | 8/1998 | Homberg et al. | |
| 5,849,248 | A | 12/1998 | Homberg | |
| 5,983,733 | A | 11/1999 | Strandberg et al. | |
| 6,352,673 | B1 | 3/2002 | Rainin et al. | |
| 6,923,938 | B2 | 8/2005 | Cote et al. | |
| 7,175,813 | B2 | 2/2007 | Petrek et al. | |
| 7,204,163 | B2 | 4/2007 | Uldry et al. | |
| 7,726,212 | B2 | 6/2010 | Magnussen et al. | |
| 7,770,475 | B2 | 8/2010 | Magnussen et al. | |

(Continued)

FOREIGN PATENT DOCUMENTS

| | | |
|---|---|---|
| GB | 2161398 | 1/1986 |

OTHER PUBLICATIONS

Socorex Isba S.A., http://socorex.com Products>digital adjustment pipettes>Calibra digital 822 highlights; website visited Dec. 4, 2014.

(Continued)

*Primary Examiner* — Robert R Raevis
(74) *Attorney, Agent, or Firm* — Andrus Intellectual Property Law, LLP

(57) ABSTRACT

A manual pipette that has a lower portion that is detachable from the upper handle portion. The piston return spring is located within the upper handle portion and is part of a plunger spring assembly that is removable and replaceable. The user is able to replace the spring or the plunger spring assembly in order to change the piston spring return force.

23 Claims, 8 Drawing Sheets

(56) References Cited

U.S. PATENT DOCUMENTS

| | | | | |
|---|---|---|---|---|
| 7,788,986 | B2 | 9/2010 | Magnussen et al. | |
| 7,819,030 | B2 | 10/2010 | Magnussen et al. | |
| 8,133,453 | B2 | 3/2012 | Molitor | |
| 8,297,134 | B2 | 10/2012 | Wilmer | |
| 8,397,593 | B2 | 3/2013 | Petrek et al. | |
| 8,646,343 | B2 | 2/2014 | Kimura et al. | |
| 8,900,526 | B2 | 12/2014 | Uldry | |
| 2005/0155438 | A1 | 7/2005 | Belgardt | |
| 2007/0014696 | A1* | 1/2007 | Molitor ..... | B01L 3/0224 422/400 |
| 2012/0039768 | A1 | 2/2012 | Strzelczyk | |
| 2014/0242719 | A1 | 8/2014 | Heinonen | |

OTHER PUBLICATIONS

Socorex Isba S.A., http://socorex.com Calibra digital product information; website visited Dec. 4, 2014.

International Search Report and Written Opinion, dated Jun. 3, 2016, in pending PCT patent application PCT/IB2016/00108.

* cited by examiner

MANUAL PIPETTE WITH SELECTABLE PLUNGER FORCE

FIELD OF THE INVENTION

The invention pertains to manual pipettes having a thumb-actuated plunger.

BACKGROUND OF THE INVENTION

Most conventional manual pipettes have a plunger button on the top of the handle. The plunger button is depressed by the user's thumb to manually lower a plunger shaft which in turn lowers a pipetting piston. A disposable pipette tip is mounted on a fitting attached to the lower portion of the pipettor. The seal around the pipetting piston causes suction in the disposable pipette tip when the piston is retracted. To aspirate liquid into the disposable pipette tip, the end of the tip is submerged in the liquid and, the user releases the plunger. A piston return spring causes the piston to retract thereby causing suction within the pipette tip to aspirate the liquid into the tip. The user then moves the pipette to a dispensing location and again depresses the plunger against the force of the spring in order to dispense the liquid from the pipette tip. Most manual pipettes also include a blowout spring mechanism that enables the plunger to move downward past the natural fully depressed range for aspiration in order to blow out residual liquid when dispensing from the tip.

The piston spring return force is normally selected by the manufacturer to be as light as possible, yet sufficient to reliably overcome friction associated with the piston seal arrangement and possibly additional friction associated with the return of the piston and plunger to the home position. In some cases, however, such a light spring force is not desirable. For example, when pipetting viscous fluids one may require greater spring return forces in order to ensure accurate and efficient liquid transfer. As another example, some users may find a pipette with a higher return spring force to be more ergonomic or comfortable to use even with non-viscous fluids.

SUMMARY OF THE INVENTION

The invention provides a convenient, reliable technique for replacing the piston return spring with another piston return spring having, for example, a different spring force.

The invention is directed to a manual pipette comprising an upper handle portion and a lower portion that is detachable from the upper handle portion. In the exemplary embodiments shown in the drawings, the lower portion includes a fitting for a disposable pipette tip. Aspects of the invention can however be implemented in manual pipettes that do not enable the use of disposable tips. A removable plunger spring assembly is mounted within the pipettor, preferably within the upper handle portion, and can be removed or replaced when the lower portion is detached from the upper handle portion. The removable plunger spring assembly includes an upper piston shaft, a piston return spring and a coupling, such as a magnet or a mechanical coupling, fixed to the lower end of the upper piston shaft. The upper plunger spring assembly also includes a spring retaining base through which the lower end of the upper piston shaft is able to slide. The upper piston shaft passes through the middle of the piston return spring. In one embodiment, the upper piston shaft includes a lubricious bearing surface, e.g., a dry layer of polytetrafluoroethylene.

An upper spring retainer is mounted at top or near the top of the piston shaft and holds the spring in compression between the upper spring retainer and the spring retaining base. A pipetting piston is located in the lower portion and is operatively coupled to the coupling on the upper piston shaft when the lower portion is attached to the upper handle portion and the manual pipette is assembled for operation. In the exemplary embodiments, the upper handle portion includes a threaded sleeve secured to its lower end, and the spring retaining base includes mating threads. The plunger spring assembly is mounted into the upper handle portion by fastening the spring retaining base of the plunger spring assembly to the threaded sleeve of the upper handle portion. The lower portion includes a threaded collar at its upper end that is attached to the upper handle portion to assemble the manual pipette for operation by fastening the threaded collar to the threaded sleeve on the upper handle portion as well.

The above described configuration facilitates convenient, reliable replacement of the piston return spring and in turn enables the user to select the force required to depress the plunger. For example, in accordance with the invention, the manual pipette can be provided as a kit with a piston return spring having a light spring force, one having an intermediate spring force, and another having a heavy spring force. Desirably, the components of the plunger spring assembly including the piston return spring are connected together as a unit, and are mounted into the upper handle portion and removed from the upper handle portion as a unit. Such a configuration enables the entire plunger spring assembly to be replaced with another plunger spring assembly having a piston return spring with a different spring return force. The various plunger spring assemblies can be made visually distinguishable if desirable, e.g., using a label or a color-coded spring retaining base. An installation tool is provided, optionally, to facilitate the attachment and detachment of the spring retaining base of the plunger spring assembly to the manual pipettor.

Other features and advantages of the invention may be apparent to those skilled in the art upon reviewing the following drawings and description thereof.

DETAILED DESCRIPTION

Figure 1:
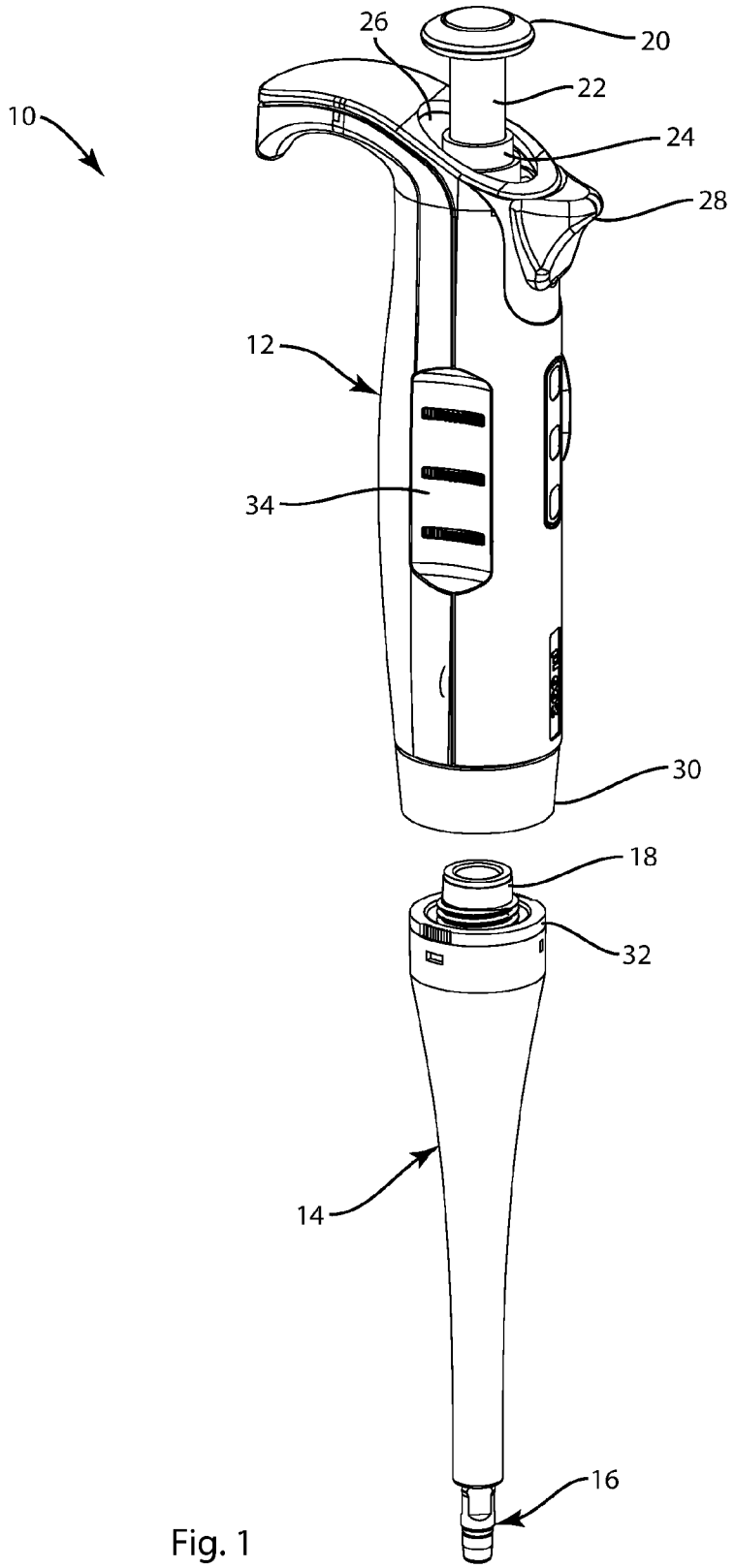
FIG. 1 is a perspective view of a single-channel, manual pipette constructed in accordance with an exemplary embodiment of the invention.

FIGS. 1 through 5 illustrate a manual pipette 10 that is constructed in accordance with an exemplary embodiment of the invention. Referring in particular to FIG. 1, the manual pipette 10 includes an upper handle portion 12 and a lower portion 14 that is detachable from the upper handle portion 12. The lower portion 14 includes a tip fitting 16 at its distal end. A disposable pipette tip, not shown, is mounted to the tip fitting 16 in order to aspirate liquid into the pipette tip for liquid transfer. As noted previously, aspects of the invention can be implemented in manual pipettes that do not enable the use of disposable tips, such as syringe-based manual pipettes. The lower portion 14 includes a threaded collar 18 at its top end which is fastened to a threaded sleeve 60, FIG. 3, located at the lower end 30 of the upper handle portion 12 in order to attach the lower portion 14 to the upper handle portion 12. In use, the upper handle portion 12 is grasped by the hand of a user. The user depresses plunger button 20 with their thumb to move the plunger shaft 22 downward against spring force, and releases the plunger button 20 to retract the plunger shaft 22 and aspirate liquid into a pipette tip mounted onto the fitting 16. Liquid is dispensed from the pipette tip by depressing the plunger button 20. A tip ejector button 28 is also located on the handle, as well as a volume adjustment mechanism 34.

Figure 2A:
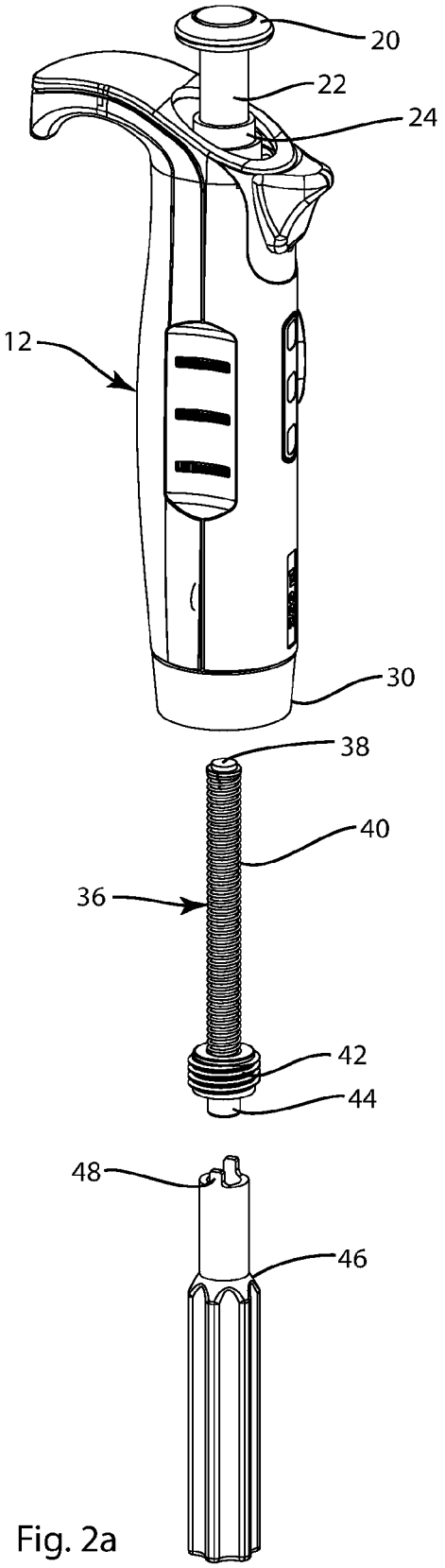
FIGS. 2*a* and 2*b* illustrate the use of an installation tool to install a plunger spring assembly constructed in accordance with the invention into an upper handle portion of the pipette shown in FIG. 1.
Figure 2B:
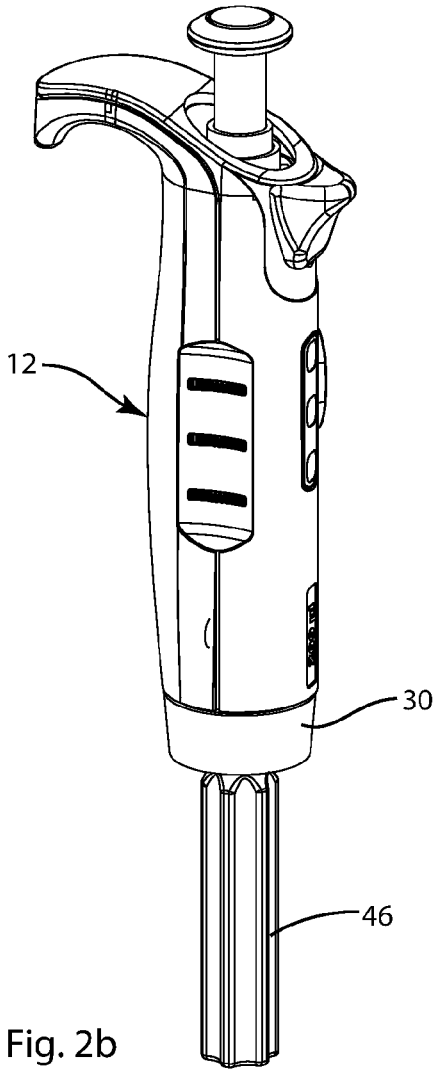

FIG. 2*a* shows a plunger spring assembly 36 removed from the upper handle portion 12 of the pipette 10. The plunger spring assembly 36 includes an upper piston shaft 38, a piston return spring 40, a spring retaining base 42, an upper spring retainer 50, FIG. 4, and a magnet 44. The magnet 44 is secured to the lower end of the upper piston shaft 38, for example with adhesive. The upper piston shaft 38 is able to slide through the spring retaining base 42, but the diameter of the magnet 44 is sufficient to hold the spring retaining base 42 on the plunger spring assembly 36. FIG. 2*a* also shows an installation tool 46 having a pair of upstanding protrusions 48. The protrusions 48 fit into an installation interface 54 (such as teeth), FIG. 4, on the spring retaining base 42, and provide means for attaching and/or detaching the plunger spring assembly 36 to the threaded sleeve 60, FIG. 3, located at the lower end 30 of the upper handle portion 12. FIG. 2*b* shows the installation tool 46 in use. Note that the lower portion 14, FIG. 1, must be removed in order for the installation tool 46 to access the threaded base 42 on the plunger spring assembly 36. While the embodiment illustrated in the drawings shows the plunger spring assembly 36 removeably mounted to the upper handle portion 12 of the pipette 10, it is contemplated that the plunger spring assembly 36 could be removeably mounted to the lower portion 14 of the pipette 10.

Figure 4:
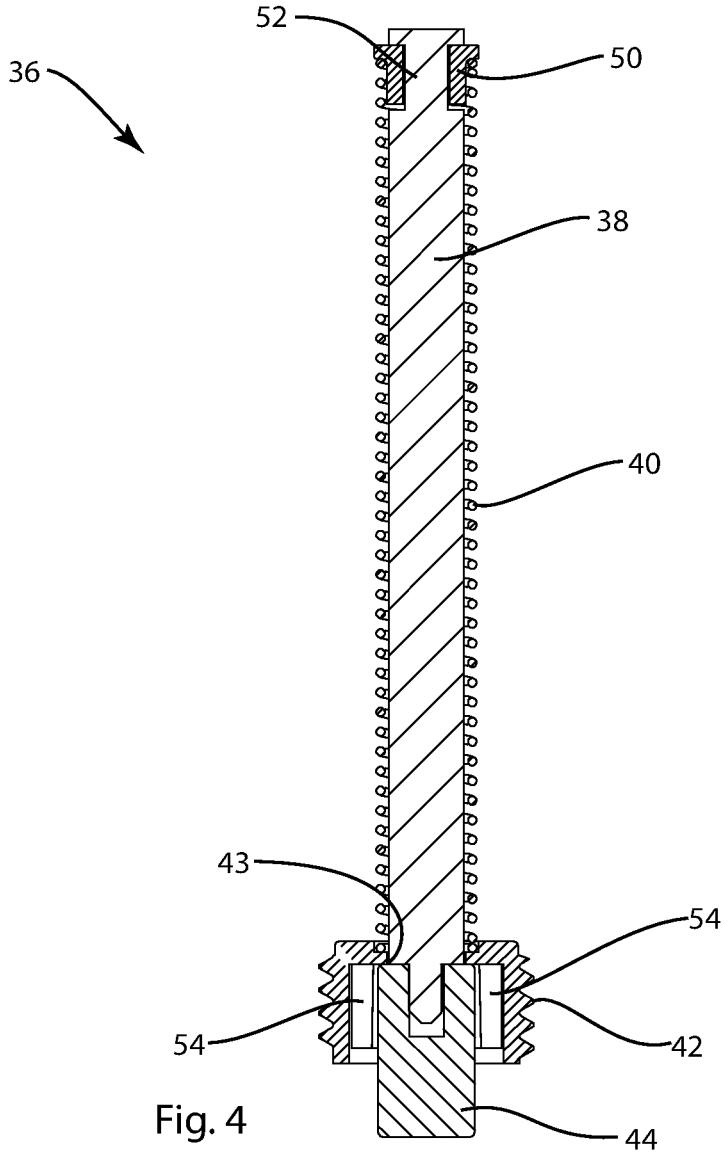
FIG. 4 is a detailed view of a plunger spring assembly constructed in accordance with a exemplary embodiment of the invention.

FIG. 4 illustrates the components of the exemplary plunger spring assembly 36. The upper piston shaft 38 preferably passes through the center of the piston return spring 40. The upper piston shaft 38 can be made of any suitable material including for example stainless steel or aluminum. The piston return spring 40 likewise can be made of any suitable material including for example stainless steel. The top end of the upper piston shaft 38 includes a circumferential recess 52 in which a spring retainer 50 is fixed. The spring retainer 50 desirably comprises dual half shells that are connected together around the piston shaft 38 within the recess 52. As mentioned, the lower end of the upper piston shaft 38 passes through a central bore 43 in the spring retaining base 42. The magnet 44 is secured to lower end of the upper piston shaft 38 via adhesive, and holds the spring retaining base 42 on the plunger spring assembly 36. The spring 40 is loaded in compression between the spring retainer 50 and the spring retaining base 42.

Figure 5:
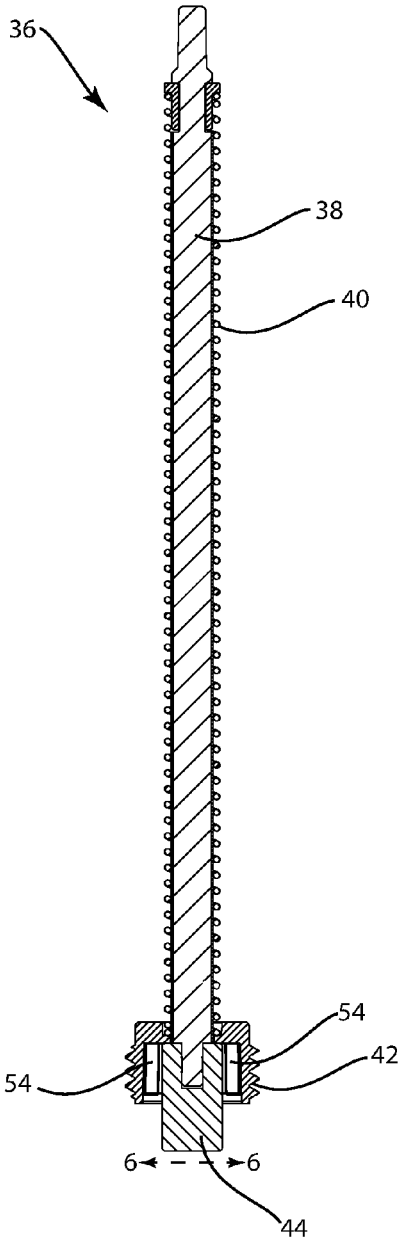
FIG. 5 is a detailed view of a plunger spring assembly constructed in accordance with another exemplary embodiment of the invention.
Figure 6:
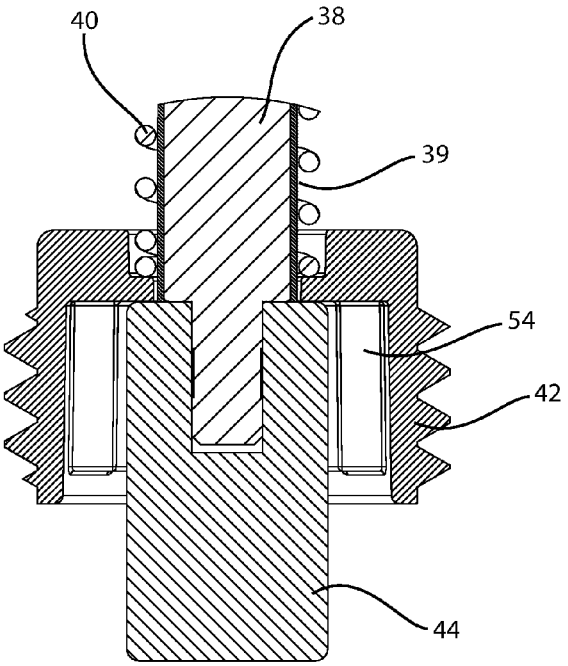
FIG. 6 is an enlarged view of the region identified by arrow 6-6 in FIG. 5.
Figure 7:
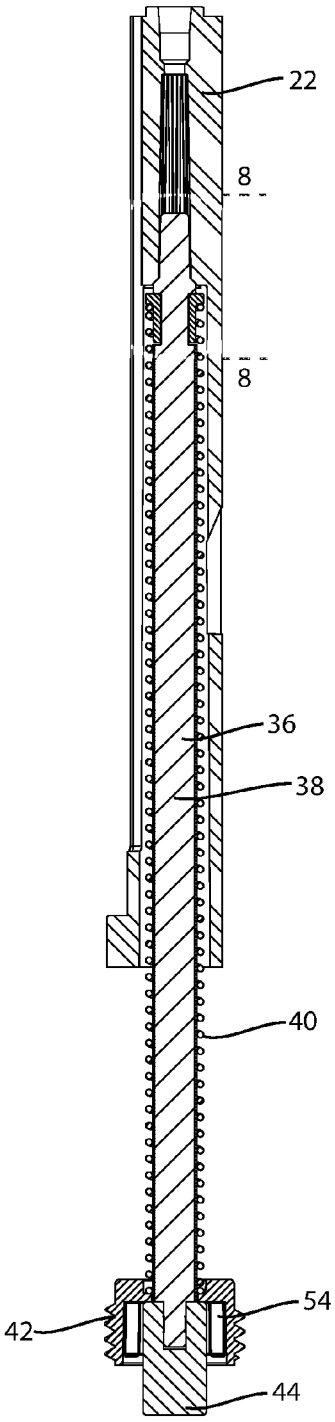
FIG. 7 a detailed view showing the plunger spring assembly in FIGS. 5 and 6 fit into the plunger shaft 22 of the pipette.
Figure 8:
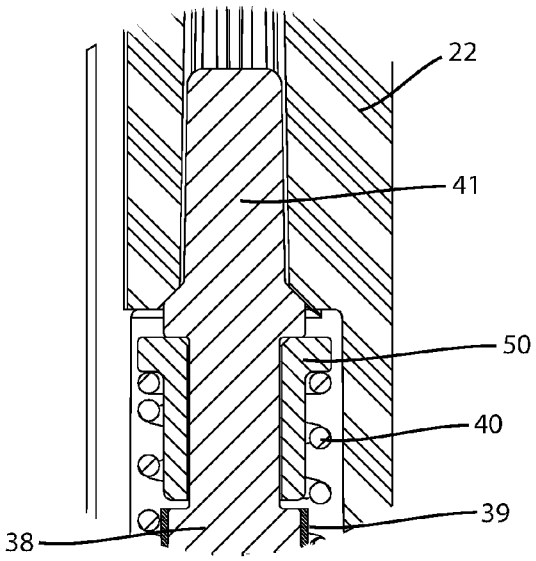
FIG. 8 is an enlarged view of the region identified by arrow 8-8 in FIG. 7.

FIGS. 5 and 6 illustrate a modified embodiment of the plunger spring assembly 36. The upper piston shaft 38 in FIGS. 5 and 6 includes a surface 39 made of lubricious material, such as a layer of heat shrink polytetrafluoroethylene. The lubricious surface 39 helps to smooth the interaction between the shaft 38 and the spring 40 when the pipette is in operation. Alternatively, lubrication can be used, but a dry lubricious surface avoids the need to handle a component with messy lubrication. Referring to FIGS. 6 and 7, the plunger spring assembly 36 in FIGS. 5 and 6 is also modified to incorporate a cone-shaped crown 41, which facilitates alignment with the plunger shaft 22, especially when reassembling the pipette.

Figure 3:
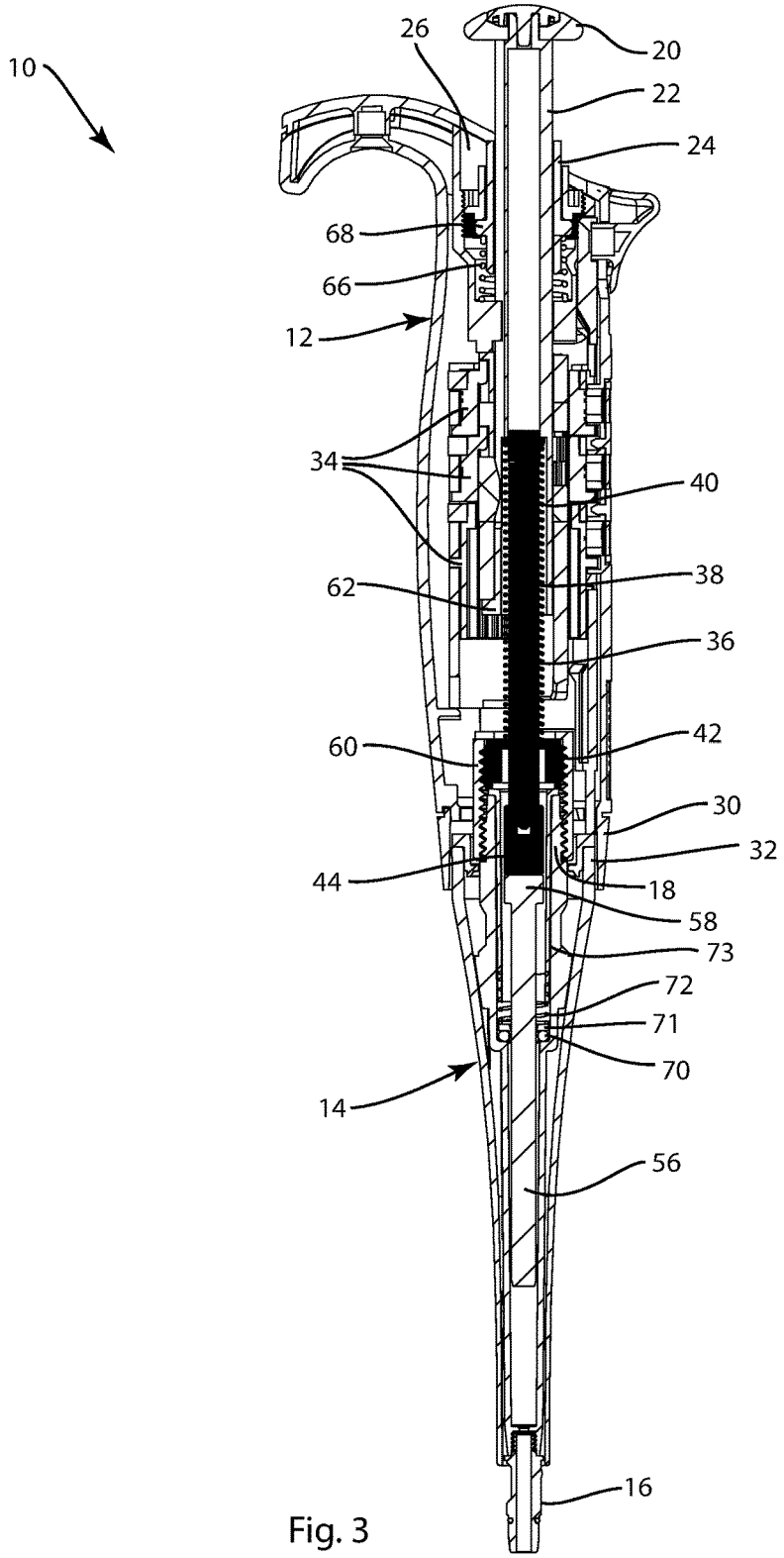
FIG. 3 is a longitudinal sectional view of the pipette illustrated in FIG. 1.

FIG. 3 illustrates a longitudinal cross-section view of the manual pipette 10 fully assembled. Pipette tip fitting 16 at the distal end of the lower portion 14 is in fluid communication with piston 56. The top portion 58 of the piston 56 is magnetically attached to the magnet 44 on the plunger spring assembly 36 that is mounted within the upper handle portion 12. An O-ring 70 and PTFE (polytetrafluoroethylene) seal 71 are secured around the piston 56. The O-ring 70 provides a static seal with the cylinder body. The PTFE seal 71 provides a dynamic seal against the piston 56. The O-ring 70 and PTFE seal 71 are held in place by spring 72 and sleeve 73 as the piston 56 extends and retracts. Retraction causes suction in a disposable pipette tip mounted on the tip fitting 16.

The plunger shaft 22 extending downward from the plunger button 20 interfaces with the top of the upper piston shaft 38. The plunger shaft 22 includes a stop 62 that physically interacts with a volume adjustment mechanism 34, which together cooperate to set the overall aspiration range of motion of the plunger 22, upper piston shaft 38 and piston 56. Stop 62 on the plunger shaft 22 resides in an area within the upper handle portion 12 that provides clearance for volume adjustment. As the user depresses the plunger button 20 downward, the plunger shaft 22 pushes downward on the upper piston shaft 38 which in turn pushes downward on the piston 56. As the plunger button 20 is pushed downward, the spring 40 compresses between the spring retainer 50 on the top of the upper piston shaft 38 and the top of the spring retaining base 42. FIG. 3 shows the upper piston shaft 38 moved partially downward through the spring retaining base 42, and consequently the spring 40 is in partial compression. Once the plunger button 20 is fully depressed, and the upper piston shaft 38 and piston 56 are pushed down to a full aspiration position, the user places the distal end of the disposable pipette tip (not shown) in the liquid and releases the plunger button 20. As the user releases the plunger button 20, the piston return spring 40 pushes the upper piston shaft 38 upward and pulls the piston 56 upward via the magnet 44. The upward motion of the piston 56 causes suction within the disposable pipette tip mounted on the tip fitting 16 to aspirate liquid into the tip.

The spring force is normally selected by the manufacturer as mentioned to overcome the friction force associated with the O-ring 70/PTFE seal 71 against the piston 56 as well as any other frictional forces along the piston, upper piston shaft 38, and plunger shaft 22. In accordance with the invention, however, the plunger spring assembly 36 is conveniently removable to facilitate replacement of the spring 40 or, alternatively, the entire plunger spring assembly 36. Replacement can be made to repair the pipette or to change the strength of the spring 40. The upper handle portion 12 includes as mentioned a threaded sleeve 60 secured to the lower end 30 of the upper handle portion 12. The spring retaining base 42 has mating threads that fasten to the threaded sleeve 60, e.g., using the installation tool 46 shown in FIGS. 2*a* and 2*b*. The threaded collar 18 on the lower portion 14 is attached to the upper handle portion 12 by fastening the threaded collar 18 to the threaded sleeve 60 as well. The spring retaining base 42 can be accessed for removal once the lower portion 14 is removed.

In order to dispense liquid from a disposable pipette tip mounted on the tip fitting 16, the user presses the plunger 20 downward to release the suction caused by the retracted piston 56. To fully complete dispensing, the user pushes downward on the plunger 20 beyond its normal full aspiration position, as is known in the art, to blow out residual liquid in the pipette tip. As the plunger button 20 is pushed downward into the depression 26 in the top of the upper handle portion 12, the plunger button 20 engages blowout sleeve 24. The blowout sleeve 24 includes a stop 68 that is normally biased upwards by spring 66. However, when the user continues to push the plunger button 20 downward against the blowout sleeve 24 and the resistance of the blow out spring 66, the upper piston shaft 38 and piston 56 are pushed further downward to facilitate blowout.

Figure 9:
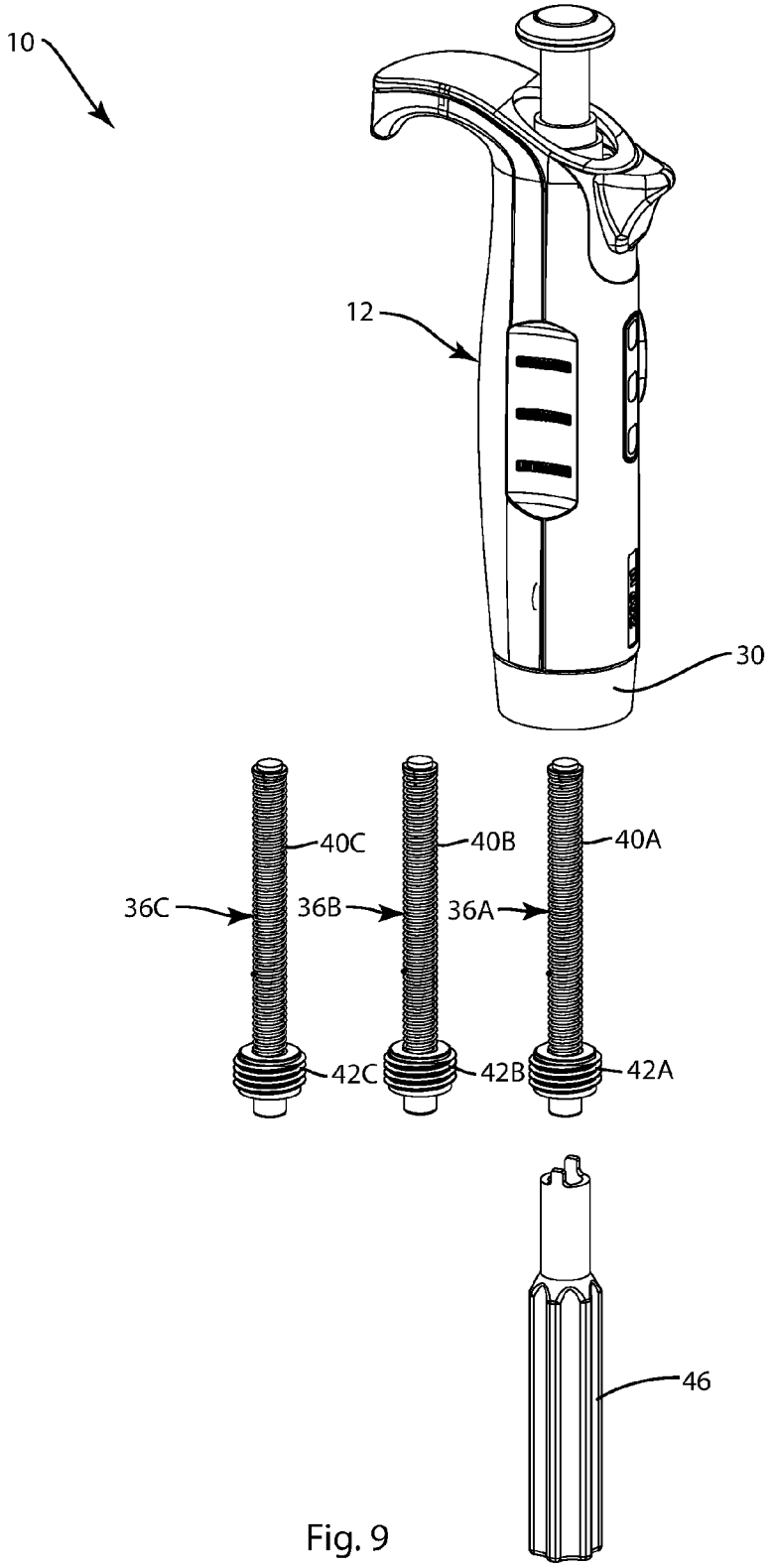
FIG. 9 is a view illustrating various components of a manual pipette kit provided with multiple plunger spring assemblies each providing a different spring return force.

Referring to now FIG. 9, it is contemplated that the manual pipette 10 may be provided to the end user as a kit with two or three (or more) plunger spring assemblies 36A, 36B and 36C. Each plunger spring assembly 36A, 36B, 36C in FIG. 5 preferably has a spring 40A, 40B, 40C providing a different spring return force. For example, spring 40A may provide a light return force, spring 40C may provide a heavy return force and spring 40B may provide an intermediate return force. The spring force level for springs 40A, 40B, 40C can be pre-selected by the manufacturer, or can be specified by the customer. Optionally, the spring retaining bases 42A, 42B, 42C may be color coded or labeled so that the user can easily determine which spring 40A, 40B, 40C is being installed or used. Alternatively, the kit can be provided with one plunger spring assembly 36 but with multiple springs.

Figure 10:
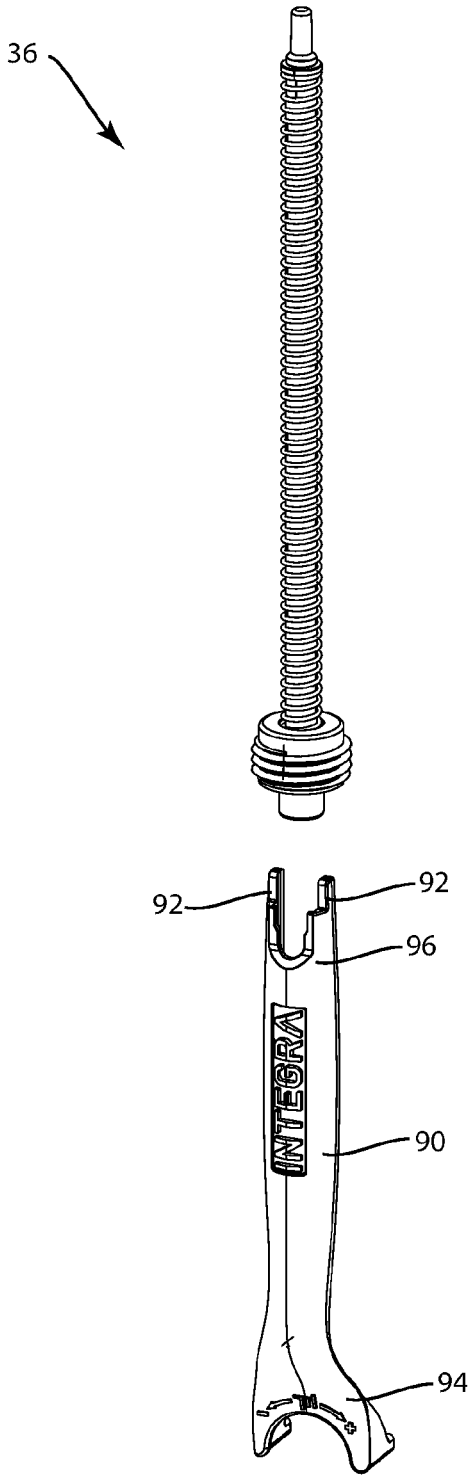
FIG. 10 illustrates an alternative tool for removing the plunger spring assembly, and also for accomplishing other tasks as well.

FIG. 10 illustrates an alternative tool 90 for removing the plunger spring assemblies 40A, 40B, and 40C shown in FIG. 5. Like the tool 46 shown in FIGS. 2 and 5, the tool 90 includes protrusion 92 to engage the installation surface 54 on the spring retaining base 42; however, the tool 90 is a three-in-one tool. It also provides a calibration fitting 94, and a fitting 96 to install and remove o-ring seals.

While the embodiments of the invention shown in the drawings is a single-channel, manual pipette, those skilled in the art will appreciate that the invention can be applied to multi-channel, manual pipettes as well.

In the foregoing description, certain terms have been used for brevity, clarity, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims. Each limitation in the appended claims is intended to invoke interpretation under 35 U.S.C. § 112, sixth paragraph, only if the terms "means for" or "step for" are explicitly recited in the respective limitation.

What is claimed is:

1. A manual pipette comprising:

an upper handle portion and a lower portion, said lower portion being detachable from the upper handle portion;

a plunger spring assembly removeably mounted within the manual pipette and removable as a unit when the lower portion is detached from the upper handle portion, the plunger spring assembly including at least an upper piston shaft, a piston return spring, a spring retaining base through which the lower end of the upper piston shaft is able to slide, an upper spring retainer secured to the upper piston shaft near its upper end such that the return spring is compressed between the upper spring retainer and the spring retaining base, and a coupling fixed to a lower end of the upper piston shaft, wherein said plunger spring assembly is adapted to be mounted within the manual pipette as a unit by removeably fastening the spring retaining base to the manual pipette;

a plunger on the upper handle portion, the plunger having a plunger shaft that interfaces with a top end of the upper piston shaft of the plunger spring assembly; and a pipetting piston located in the lower portion, said pipetting piston operatively coupled to the coupling fixed to the lower end of the upper piston shaft when the plunger spring assembly is installed, and the lower portion of the manual pipette is attached to the upper handle portion and the manual pipette is assembled for operation.

2. The manual pipette as recited in claim 1 wherein the spring retaining base has a central bore through which the lower end of the upper piston shaft is able to slide and the spring retaining base is held on the plunger spring assembly when it is removed from the manual pipette.

3. The manual pipette as recited in claim 2 wherein a mechanical stop moving in unison with the lower end of the upper piston shaft and located below the spring retaining base holds the spring retaining base to the plunger spring assembly when the plunger spring assembly is removed from the manual pipette.

4. The manual pipette as recited in claim 1 wherein a top of the upper piston shaft includes a cone-shaped crown.

5. A manual pipette as recited in claim 1 wherein the manual pipette is a multi-channel pipette comprising in the lower portion a main piston drive shaft that attaches to and detaches from the coupling fixed to a lower end of the upper piston shaft, a piston drive bar and multiple pipetting pistons.

6. A manual pipette as recited in claim 5 wherein the coupling fixed to a lower end of the upper piston shaft is a mechanical coupling.

7. A manual pipette as recited in claim 6 wherein the manual pipette is a single channel pipette and the pipetting piston is magnetically coupled to the magnet fixed to the lower end of the upper piston shaft when the lower portion is attached to the upper handle portion and the manual pipette is assembled for operation.

8. A manual pipette as recited in claim 1 wherein the coupling fixed to a lower end of the upper piston shaft is a magnet.

9. A manual pipette as recited in claim 1 wherein the upper piston shaft comprises a dry lubricious surface layer.

10. The manual pipette as recited in claim 9 wherein the dry lubricious surface layer on the upper piston shaft comprises a layer of heat shrink polytetrafluoroethylene.

11. A manual pipette as recited in claim 1 wherein the plunger spring assembly is mounted into the upper housing portion by fastening the spring retaining base to a lower end of the upper handle portion.

12. A manual pipette as recited in claim 1 wherein:

the upper handle portion includes a threaded sleeve secured at its lower end; and the spring retaining base includes mating threads, wherein said plunger spring assembly is adapted to be mounted to the upper handle portion by fastening the mating threads of the spring retaining base to the threaded sleeve secured to the lower end of the upper handle portion.

13. A manual pipette as recited in claim 12 wherein the lower portion of the manual pipette has a threaded collar at its upper end and the lower portion is attached to the upper handle portion to assemble the manual pipette for operation by fastening the threaded collar on the lower portion to the threaded sleeve on the upper handle portion.

14. A manual pipette as recited in claim 1 wherein the spring retaining base on the plunger spring assembly includes an installation interface for engaging an installation tool to attach or detach the spring retaining base from the manual pipette when the lower portion is detached from the upper handle portion.

15. The manual pipette as recited in claim 14 wherein the installation tool has at least two protrusions for engaging the installation interface on the spring retaining base.

16. The manual pipette as recited in claim 1 further comprising a fitting on the lower portion for a disposable pipette tip.

17. A manual pipette kit comprising:

a manual pipette with an upper handle portion and a lower portion, said lower portion being detachable from the upper handle portion;

a first plunger spring assembly adapted to be removeably mounted within the manual pipette and removable as a unit when the lower portion is detached from the upper handle portion, the first plunger spring assembly including at least a first upper piston shaft, a first piston return spring, a first spring retaining base through which the lower end of the first upper piston shaft is able to slide, a first upper spring retainer secured to the first upper piston shaft near its upper end such that the first piston return spring is compressed between the first upper spring retainer and the first spring retaining base, and a first coupling fixed to a lower end of the first upper piston shaft, wherein said first plunger spring assembly is adapted to be mounted within the manual pipette as a unit by removeably fastening the first spring retaining base to the manual pipette;

a plunger on the upper handle portion, the plunger having a plunger shaft that interfaces with a top end of the upper piston shaft;

a pipetting piston located in the lower portion, said pipetting piston operatively coupled to the coupling fixed to the lower end of the upper piston shaft when the lower portion is attached to the upper handle portion and the manual pipette is assembled for operation; and a second piston return spring, the second piston return spring having a spring force that is heavier than the spring force of the first piston return spring.

18. A manual pipette kit as recited in claim 17 further comprising a second plunger spring assembly adapted to be removeably mounted within the manual pipette and removable as a unit when the lower portion is detached from the upper handle portion, the second plunger spring assembly including at least a second upper piston shaft, the second piston return spring, a second spring retaining base through which the lower end of the second upper piston shaft is able to slide, a second upper spring retainer secured to the second upper piston shaft near its upper end such that the second piston return spring is compressed between the second upper spring retainer and the second spring retaining base, and a second coupling fixed to a lower end of the second upper piston shaft, wherein said second plunger spring assembly is adapted to be mounted within the manual pipette as a unit by removeably fastening the second spring retaining base to the manual pipettor.

19. A manual pipette kit as recited in claim 18 wherein the upper handle portion comprises a threaded sleeve secured its lower end, and the first and second retaining bases including mating threads, wherein each of the first and second plunger spring assemblies are capable of being mounted to the upper handle portion by fastening the mating threads of the respective spring retaining base to the threaded sleeve secured to the lower end of the upper handle portion.

20. A manual pipette kit as recited in claim 19 wherein the lower portion of the manual pipette has a threaded collar at its upper end and the lower portion is attached to the upper handle portion to assemble the manual pipette for operation by fastening the threaded collar on the lower portion to the threaded sleeve on the upper handle portion.

21. A manual pipette kit as recited in claim 18 wherein the spring retaining bases on the plunger spring assemblies each include an installation interface for engaging an installation tool to attach the respective base to and detach the respective base from the manual pipettor.

22. The manual pipette kit as recited in claim 21 wherein the installation tool has at least two protrusions for engaging the installation interface on the respective spring retaining bases.

23. A manual pipette kit as recited in claim 18 further comprising:

a third plunger spring assembly adapted to be removeably mounted within the manual pipette as a unit and removable when the lower portion is detached from the upper handle portion, the third plunger spring assembly including at least a third upper piston shaft, the third piston return spring, a third spring retaining base through which the lower end of the third upper piston shaft is able to slide, a third upper spring retainer secured to the third upper piston shaft near its upper end such that the third piston return spring is compressed between the third upper spring retainer and the third spring retaining base, and a third coupling fixed to a lower end of the third upper piston shaft, wherein said third plunger spring assembly is adapted to be mounted within the manual pipette as a unit by removeably fastening the third spring retaining base to the manual pipette;

wherein the third piston return spring has a spring force that is heavier than the spring force of the first piston return spring and lighter than the spring force of the second piston return spring.

* * * * *